US007146957B2

(12) United States Patent
Kraus et al.

(10) Patent No.: US 7,146,957 B2
(45) Date of Patent: Dec. 12, 2006

(54) INTERNAL COMBUSTION ENGINE

(75) Inventors: Markus Kraus, Wiesing (AT); Diethard Plohberger, Jenbach (AT); Stephan Laiminger, Kirchbichl (AT); Thomas Guggenberger, Jenbach (AT)

(73) Assignee: GE Jenbacher GmbH & Co. OHG (AT)

( * ) Notice: Subject to any disclaimer, the term of this patent is extended or adjusted under 35 U.S.C. 154(b) by 0 days.

(21) Appl. No.: 10/861,024

(22) Filed: Jun. 4, 2004

(65) Prior Publication Data

US 2004/0244753 A1 Dec. 9, 2004

(30) Foreign Application Priority Data

Jun. 4, 2003 (AT) ..... A 864/2003

(51) Int. Cl.
*H01T 13/02* (2006.01)
*F02P 15/00* (2006.01)

(52) U.S. Cl. ..... 123/143 C; 123/169 PA

(58) Field of Classification Search ..... 123/143 C, 123/169 PA, 169 PH; 439/125–130
See application file for complete search history.

(56) References Cited

U.S. PATENT DOCUMENTS

| | | | | |
|---|---|---|---|---|
| 3,697,796 | A | 10/1972 | Livingston | 313/134 |
| 4,274,695 | A * | 6/1981 | Fukumori et al. | 439/424 |
| 4,715,337 | A | 12/1987 | Bohl et al. | 123/169 |
| 5,377,640 | A * | 1/1995 | Kobayashi | 123/143 C |
| 5,385,686 | A * | 1/1995 | Miller et al. | 508/215 |
| 5,462,023 | A * | 10/1995 | Furuya | 123/143 C |
| 5,549,082 | A * | 8/1996 | Kobayashi | 123/143 C |
| 5,577,921 | A | 11/1996 | Philyaw et al. | 439/125 |
| 5,592,911 | A * | 1/1997 | Komatsu | 123/143 C |
| 5,628,298 | A * | 5/1997 | Murata | 123/635 |
| 5,662,095 | A * | 9/1997 | Matsuo | 123/143 C |
| 5,685,282 | A * | 11/1997 | Murata et al. | 123/635 |
| 5,799,633 | A * | 9/1998 | Miller | 123/143 C |
| 5,878,706 | A * | 3/1999 | Akamatsu | 123/143 C |
| 6,068,495 | A * | 5/2000 | Virchow | 439/125 |
| 6,193,528 | B1 * | 2/2001 | Rea et al. | 439/127 |
| 6,427,674 | B1 * | 8/2002 | Wylin | 123/634 |
| 6,467,447 | B1 * | 10/2002 | Holmes et al. | 123/169 PA |
| 6,635,605 | B1 * | 10/2003 | Como et al. | 508/183 |
| 6,926,266 | B1 * | 8/2005 | Paul et al. | 267/174 |
| 2005/0066776 | A1 * | 3/2005 | Ward et al. | 81/53.2 |
| 2005/0199411 | A1 * | 9/2005 | Doll | 174/86 |

FOREIGN PATENT DOCUMENTS

| | | |
|---|---|---|
| DE | 760 104 | 10/1952 |
| DE | 3920080 A1 | 1/1991 |
| DE | 4340616 A1 | 11/1993 |
| EP | 0 530 883 A2 | 8/1992 |
| GB | 2 241 739 A | 9/1991 |

(Continued)

OTHER PUBLICATIONS

*European Search Report-Examine E.Bijn; Jul. 9, 2004.

*Primary Examiner*—Hai Huynh
(74) *Attorney, Agent, or Firm*—Lorusso & Associates

(57) ABSTRACT

An internal combustion engine, in particular a stationary gas engine, comprising at least one spark plug connector plug device (2) which can be fixed to the internal combustion engine, wherein the spark plug connector plug device (2) and the fixing thereof to the internal combustion engine withstand an application of force exerted on the spark plug connector plug device of at least 1000 Newtons, preferably in the longitudinal direction of the spark plug connector plug device (2).

19 Claims, 6 Drawing Sheets

FOREIGN PATENT DOCUMENTS

Figure 1:
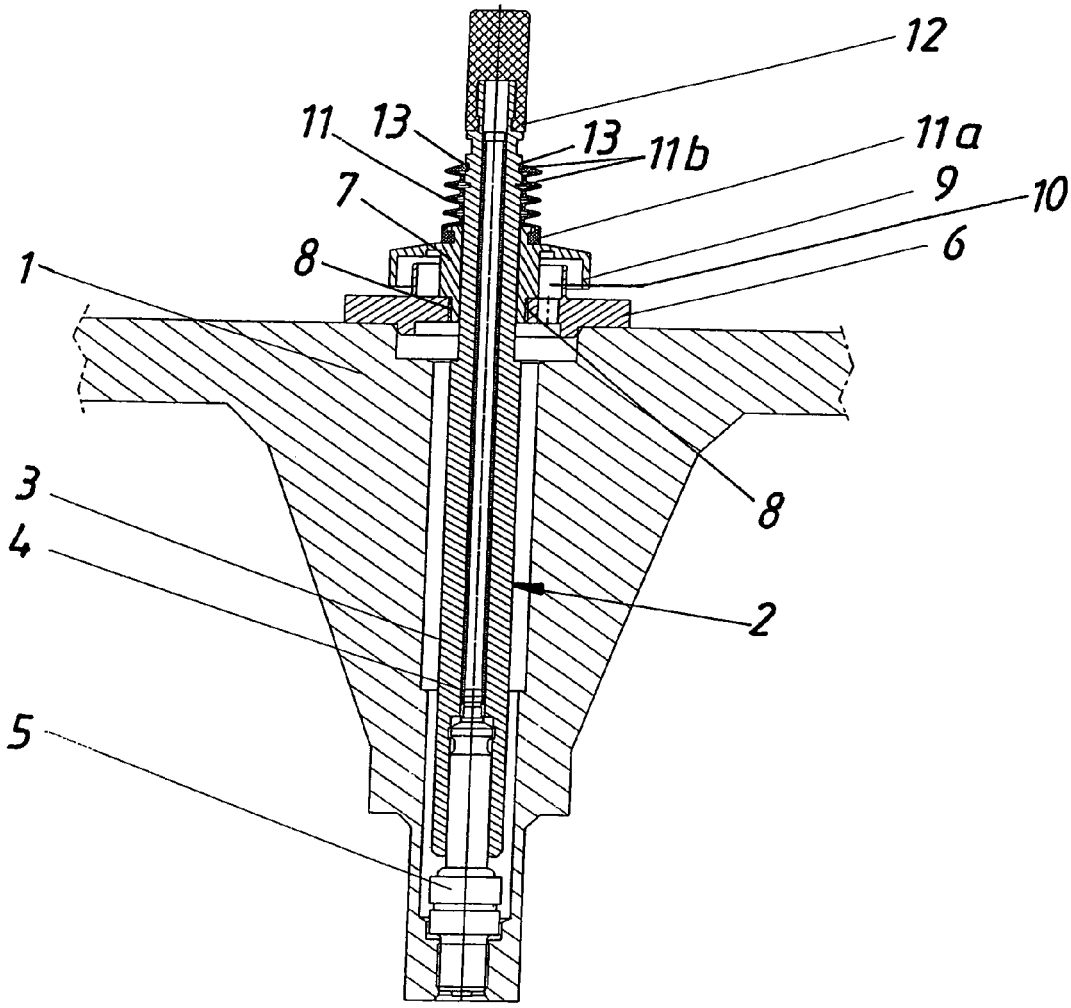

| | | | | |
|---|---|---|---|---|
| JP | 09106878 | A | | 4/1997 |
| JP | 09129355 | A | | 5/1997 |
| JP | 9-260015 | | * | 10/1997 |
| JP | 11054238 | A | | 2/1999 |
| JP | 2002054543 | | | 10/2000 |
| JP | 2000-323258 | | * | 11/2000 |
| JP | 2000323258 | A | | 11/2000 |
| JP | 2002-75586 | | * | 3/2002 |

* cited by examiner

INTERNAL COMBUSTION ENGINE

The present invention concerns an internal combustion engine, in particular a stationary gas engine, comprising at least one spark plug connector plug device which can be fixed to the internal combustion engine, and a spark plug connector plug device per se.

EP 0 530 883 proposes fixing a spark plug connector plug device to the engine block by means of a plate and a screw in order to ensure that the spark plug connector plug device cannot be unintentionally pulled off the spark plug.

Particularly in the case of large-size engines or large internal combustion engines such as for example stationary gas Otto cycle engines for driving electrical generators, under some circumstances, caused by production faults or due to thermal or mechanical overloading of the spark plug, it can happen that the ceramic body or other components of the spark plug are expelled out of the spark plug casing. That situation usually occurs at very high pressures in the combustion chamber of the engine. In a fault situation the components of the spark plug are accelerated very vigorously due to the high pressure in the combustion chamber and are shot out of the engine. That signifies danger both to the people in the area around the engine and also to the engine itself.

Therefore the object of the present invention is to provide an internal combustion engine in which spark plugs or spark plug parts which are shot or pushed out of the engine in a fault situation are caught by a structure which is technically as inexpensive as possible and which is simple to handle.

According to the invention that is attained in that the spark plug connector plug device and the fixing thereof to the internal combustion engine withstand an application of force exerted on the spark plug connector plug device, preferably in the longitudinal direction of the spark plug connector plug device, of at least 1000 Newtons.

The strength of the spark plug connector plug device, in accordance with the invention, and the fixing to the internal combustion engine, effectively ensure that in a fault situation individual parts or the entire spark plug cannot be pushed or shot out of the engine. If a fault situation should arise, then the parts which are shot out can be caught and intercepted by the spark plug connector plug device as it withstands a corresponding force acting thereon. That effectively reduces the danger to a person and the machine due to spark plugs or parts thereof being shot out of the engine. Here 1000 Newtons approximately corresponds to the maximum force which acts on a spark plug in engines with maximum pressures of up to 100 bars in the combustion chamber.

In the case of engines with higher maximum pressures, the spark plug connector plug device and the fixing thereof are to be of a correspondingly stronger design. In that case it is desirable if the spark plug connector plug device and the fixing thereof to the internal combustion engine withstand an application of force exerted on the spark plug connector plug device, preferably in the longitudinal direction of the spark plug connector plug device, of at least 3000 Newtons, preferably at least 5000 Newtons. That applies in particular for engines in which maximum internal pressures of 250 bars or 300 bars prevail in the combustion chamber. In addition, in the case of engines with correspondingly far increased internal pressures in the combustion chamber, it is desirable to provide that the spark plug connector plug device and the fixing thereof to the internal combustion engine withstand applications of force of at least 7000 Newtons or at least 10,000 Newtons respectively.

As, in operation of internal combustion engines, the engine block and therewith also the spark plug connector plug device and its fixing to the internal combustion engine heat up, it is desirably to be provided that the spark plug connector plug device and the fixing thereof to the internal combustion engine withstand an application of force applied to the spark plug connector plug device at the level of the above-specified values at temperatures of up to 80° C., preferably up to 100° C.

In order to permit quick and easy maintenance of the spark plugs, good accessibility is an important consideration. Therefore a further aspect of the present invention provides that the spark plug connector plug device can be fixed to the internal combustion engine with a locking mechanism which can be fixed and released without the use of a tool and which involves a positively locking relationship, preferably with a bayonet fixing or with a screw means. By virtue of that kind of fixing it is possible on the one hand to provide for rapid removal of the spark plug connector plug device by hand, while on the other hand however the necessary strength is achieved by the positively locking mechanism.

Figure 2:
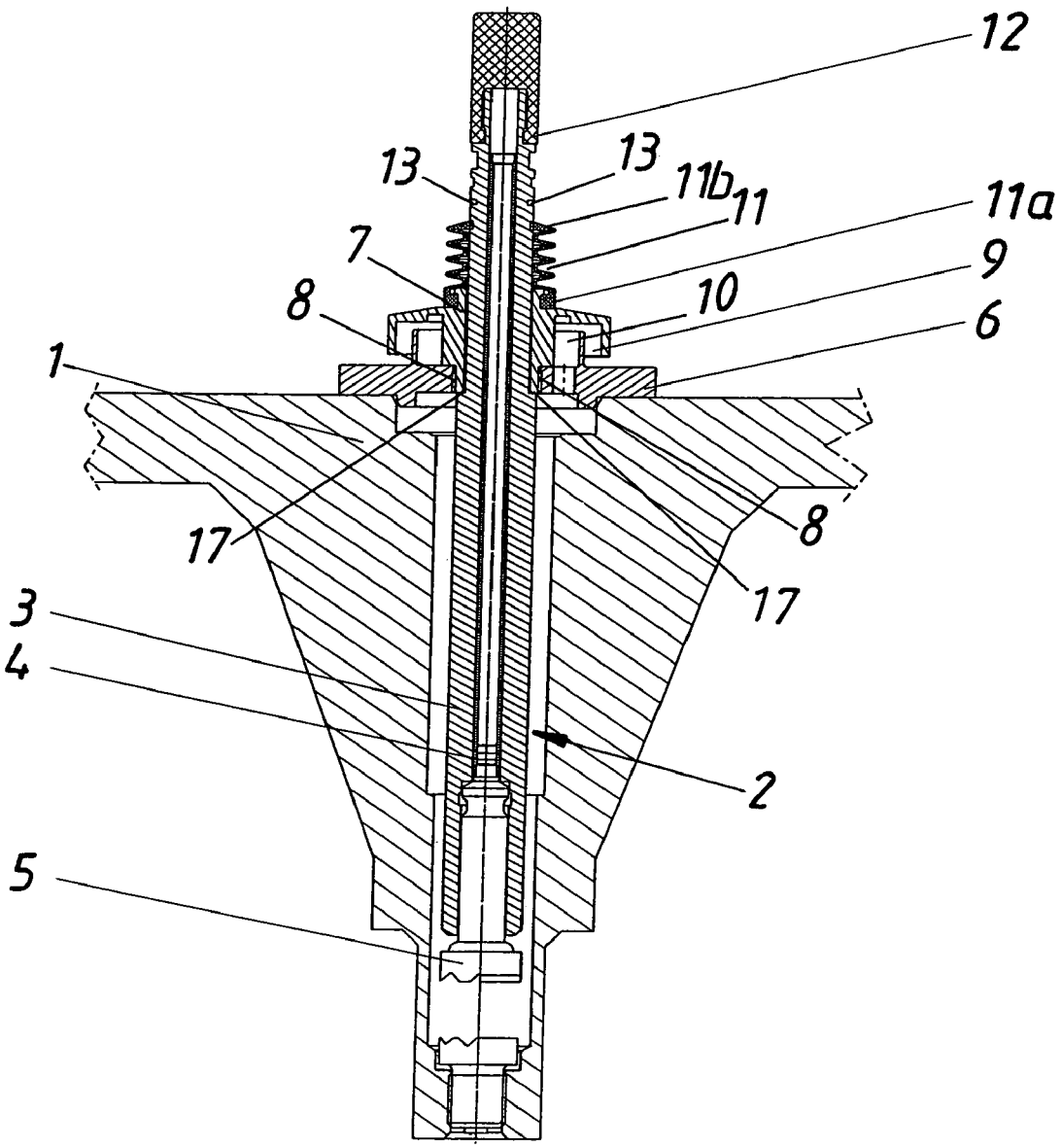
Figure 3:
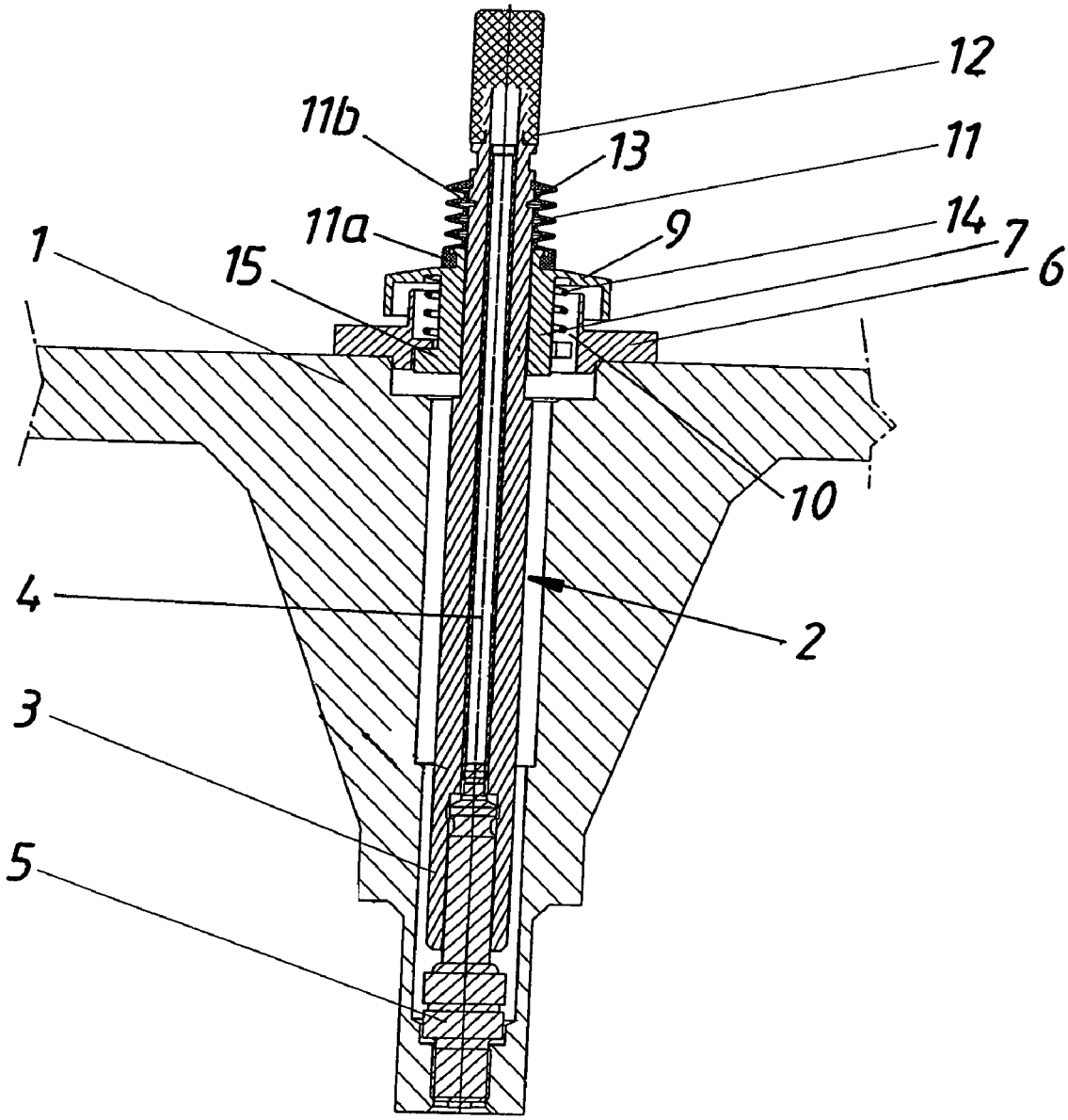
Figure 4:
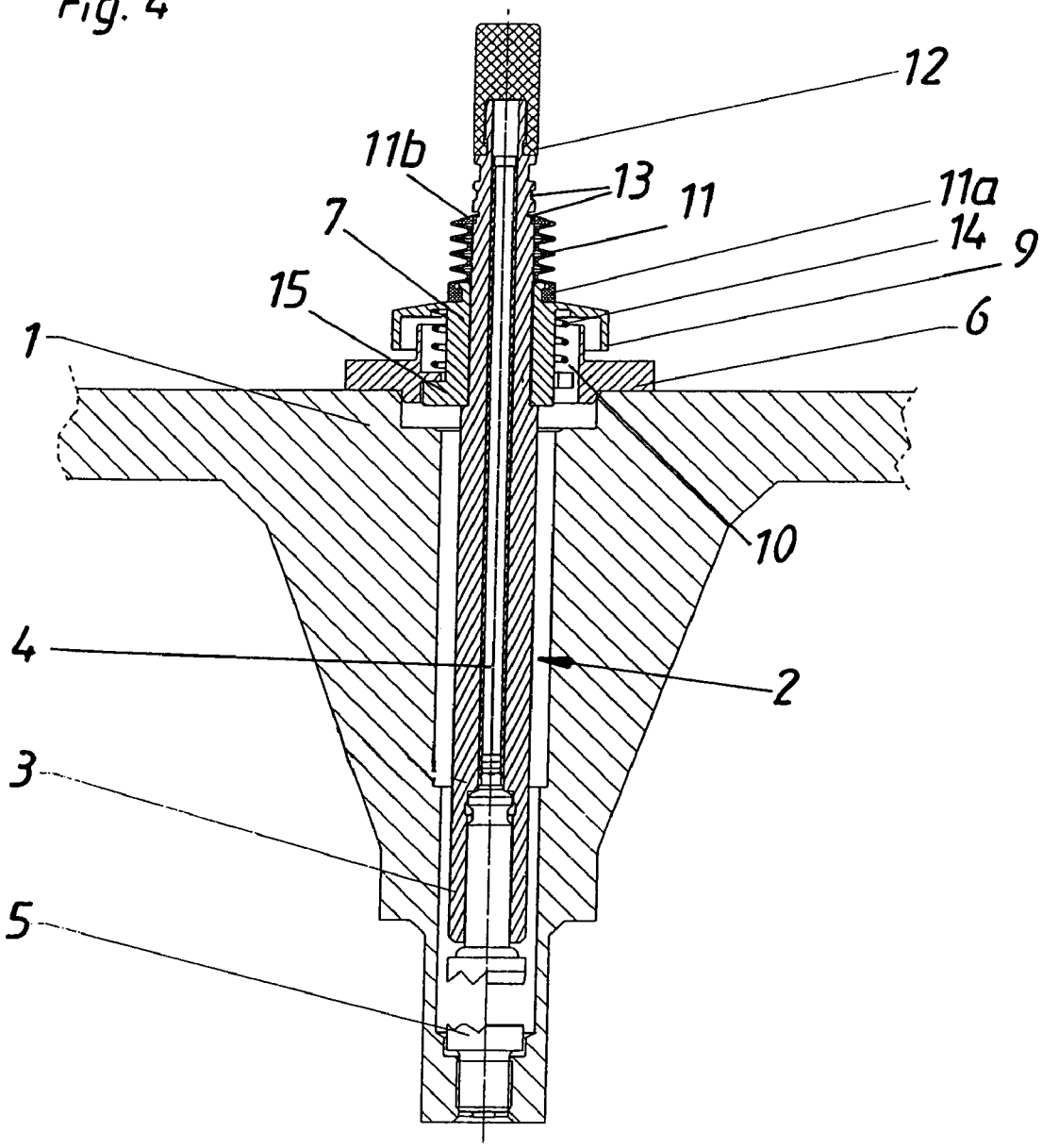
Figure 5:
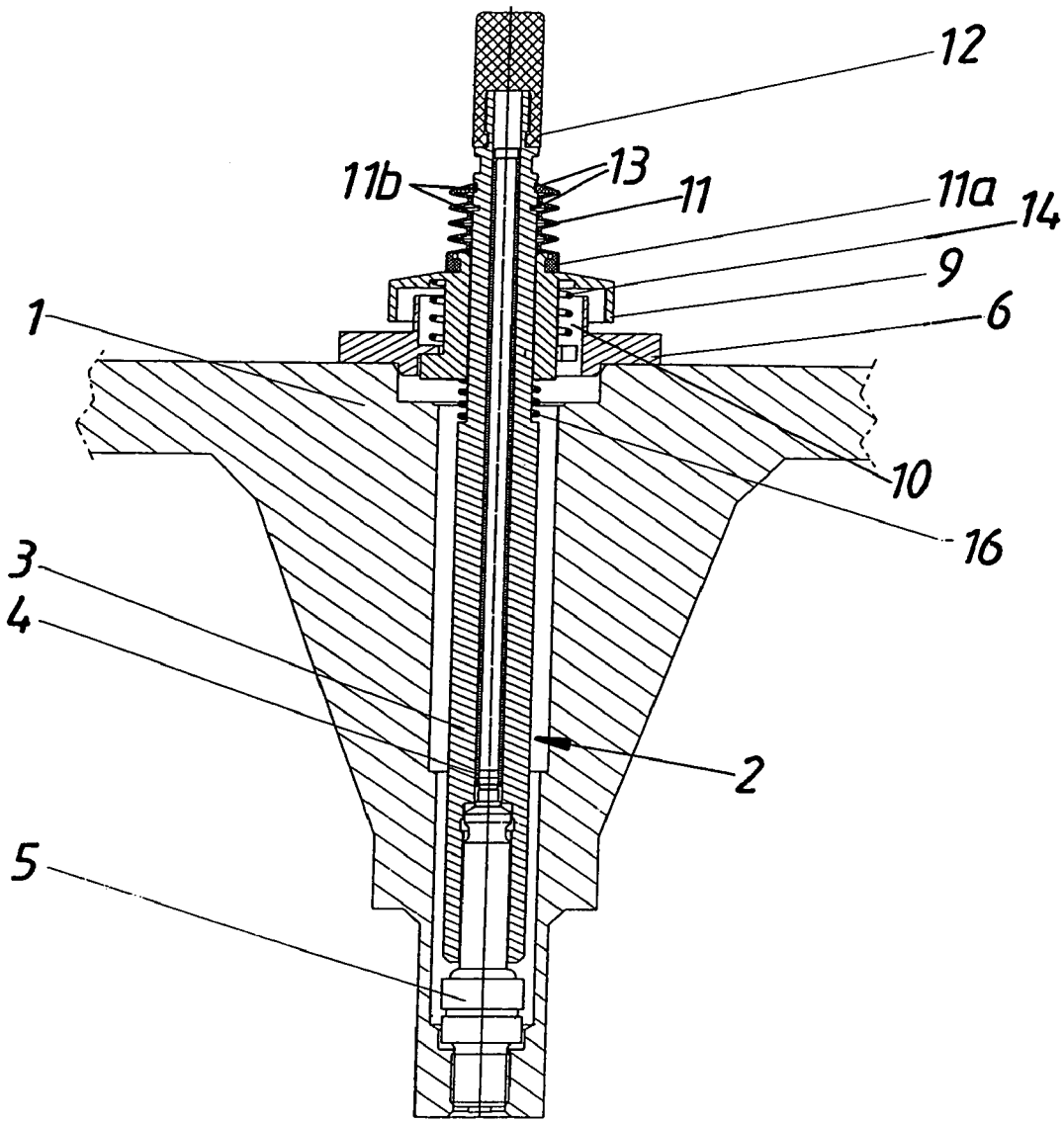
Figure 6:
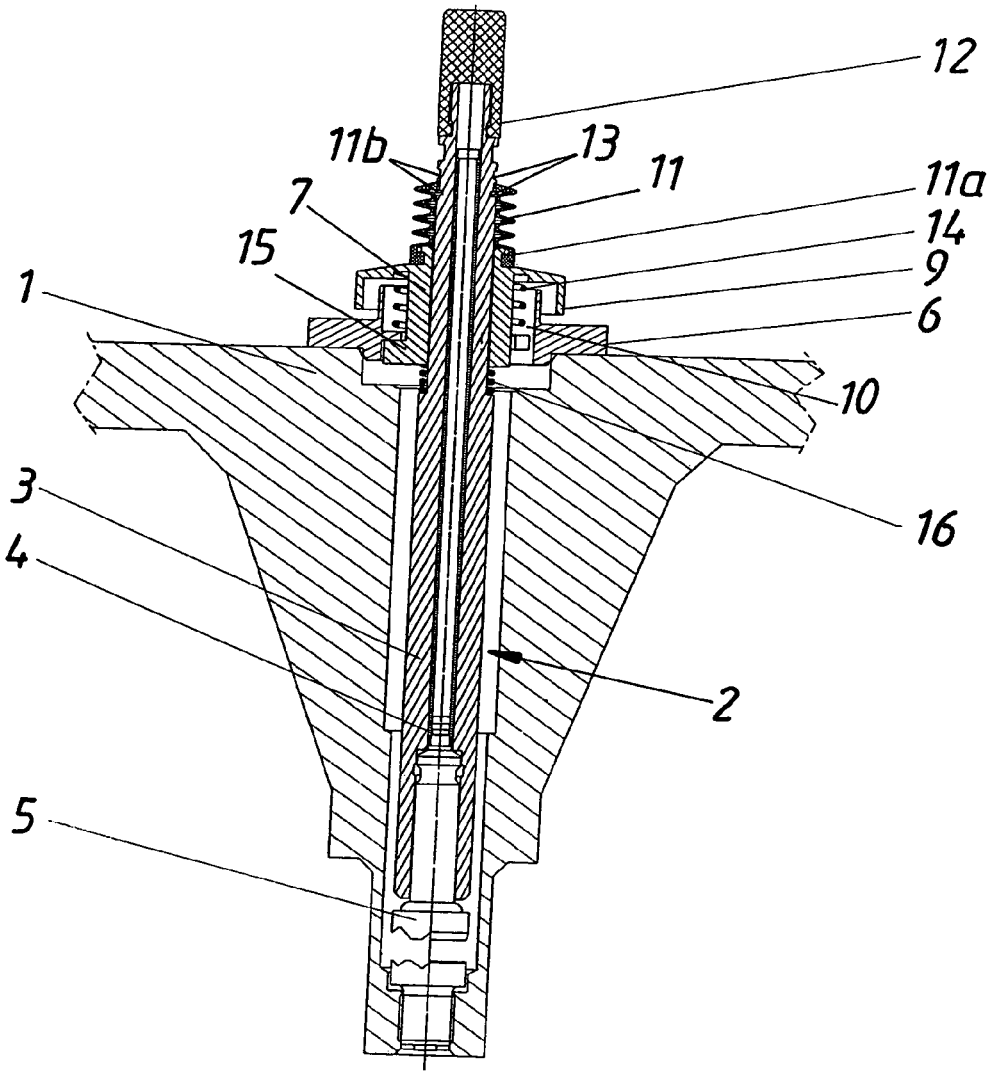
Figure 7:
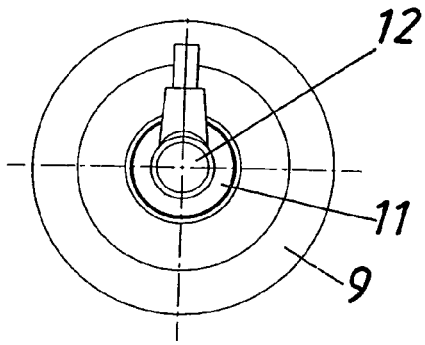

Further features and details of the present invention will be apparent from the specific description hereinafter. In the drawing:

FIG. 1 shows a first variant according to the invention, in which the locking mechanism has a screw connection, FIG. 2 shows the first embodiment of FIG. 1 in a fault situation, FIG. 3 shows a second embodiment in which the locking mechanism has a bayonet fastening, FIG. 4 shows the second embodiment of FIG. 3 in the fault situation, FIG. 5 shows a third embodiment with a bayonet fastening as the locking element and a spring element for damping in a fault situation, FIG. 6 shows the third embodiment of FIG. 5 in the fault situation, and FIG. 7 shows a plan view of the three embodiments shown in FIGS. 1 through 6.

All three embodiments as shown in FIGS. 1 through 7 are connected to the internal combustion engine in positively locking and force-locking relationship by means of a releasable locking mechanism. In the illustrated embodiments fixing is effected to the engine block 1 or the valve cover connected to the engine block 1 over the cylinder head. In the first embodiment shown in FIGS. 1 and 2 the locking mechanism has a screw means 8 and in the two further embodiments shown in FIGS. 3 through 6 it has a bayonet fastening. The locking mechanism is so designed that the kinetic and pneumatic forces in the fault situation of a spark plug being pushed or shot out can be specifically reduced.

The kinetic energy of the components of the spark plug which are accelerated out of the combustion chamber due to the high pneumatic pressure, or of the spark plug itself, has to be absorbed in a fault situation by the spark plug connector plug device 2 and its fixing to the internal combustion engine. In that respect the kinetic energy occurs at a particularly high loading peak upon release of components of the spark plug or upon release of the spark plug itself. The reduction in that loading peak is ensured by the spark plug coupling plug device 2 and its fixing to the engine block (the locking mechanism). The reduction in kinetic energy can be ensured by deformation of the casing 3 of the spark plug connector plug device 2 and/or by spring elements 16 additionally arranged on the spark plug connector plug device. The remaining energy is absorbed by the locking mechanism which involves a locking action in positively locking or force-locking relationship. Deformation can take place elastically. In the case of a suitable design however it can also be provided that the casing 3 and the electrode 4 are plastically deformed in the fault situation and then have to be replaced.

In that case desirably only the plastically deformed parts of the spark plug connector plug device 2 are replaced and the remainder continues to be used.

In the alternative embodiments shown in FIGS. 1 through 4 in which the kinetic energy is substantially reduced by elastic deformation of the spark plug connector plug device, the casing 3 of the spark plug connector plug device desirably has a modulus of elasticity of less than 2000 MPa, preferably less than 1000 MPa. It is however also possible to envisage even lower moduli of elasticity of less than 700 MPa or less than 500 MPa. To achieve those values, the casing can for example comprise polytetrafluoroethylene which is sold under the trade mark Teflon. It is however also possible to envisage other plastic materials with corresponding elastic properties and strength values. In general the man skilled in the art must so select the material and the dimensions of the spark plug connector plug device that the spark plug connector plug device withstands the application of force when the spark plug or parts thereof are expelled, in accordance with the invention. In addition the electrical high-voltage strength is ensured by the use of plastic materials for making the casing 3 of the spark plug connector plug device 2.

The locking mechanism is desirably made from a material which is of higher strength or stiffness than the casing 3. Metals are particularly preferred for making the locking mechanism.

In the event of destruction of the spark plug, the compressed gas escapes from the combustion chamber of the engine. The surface area of the locking mechanism, at which forces are applied, is generally much larger than the force-application surface area of the spark plug, so that there would be a fear that the high pneumatic pressure from the combustion chamber could result in overloading of the locking mechanism. In order to prevent that overloading due to the pneumatic energy, the arrangement provides for a specific and deliberate discharge of gas through one or more gas discharge openings or passage means 10 in the locking mechanism. The total cross-sectional area of those passage means 10 is such that the gas in a fault situation, even at very high pressure conditions in the combustion chamber, can escape so quickly that the locking mechanism is not overloaded by the total of the kinetic and pneumatic forces acting on it. The passage means 10 is desirably in the form of a labyrinth configuration, wherein the passage means is covered in such a way as to be resistant to splash and spray water, preferably by a cover 9. The passage means 10 can be arranged in the spark plug connector plug device 2 and/or in the engine block 1 and/or between the spark plug connector plug device 2 and the engine block 1.

A first embodiment is shown in FIG. 1. The spark plug connector plug device 2 has a casing 3 of polytetrafluoroethylene (known under the trade name of Teflon) and a center electrode 5 and at the combustion chamber side encloses the insulator and the connecting electrode of a per se known spark plug 5. For fixing to the engine block 1 the spark plug connector plug device 2 has a locking mechanism with a screw connection 8. The screw connection 8 is formed on the one hand by a screwthread on the part 7 of the locking mechanism, which is towards the spark plug connector plug device, and on the other hand by a screwthread on the part 6 of the locking mechanism, which is towards the engine block. Arranged on the part 7 which is towards the spark plug connector plug device is a spray water-resistant cover 9 which at the same time serves as a handle for screwing the spark plug connector plug device in and out. The part 7 towards the spark plug connector plug device is connected by way of a holding sleeve 11 to the casing 3 of the spark plug connector plug device 2. The holding sleeve 11 engages on the one hand over the bead 11*a* on the part 7 towards the spark plug connector plug device and on the other hand with the beads 11*b* in recesses 13 in the casing 3 of the spark plug connector plug device 2. Contacting of the center electrode 4 with the ignition cables is effected by means of the plug device 12 of an ignition cable.

For reducing the pneumatic forces, provided in the locking mechanism is the labyrinth-like passage means 10 which is covered by the cover in such a way as to be resistant to spray water.

FIG. 2 shows the embodiment according to the invention as shown in FIG. 1 in a fault situation. As diagrammatically illustrated the spark plug 5 has been expelled by virtue of an increased pressure in the engine and has been intercepted by the spark plug connector plug device 2. Reduction in the kinetic forces of the spark plug or the shot-out parts thereof is effected essentially by elastic and/or plastic deformation of the casing 3 of the spark plug connector plug device 2. In addition however, as shown in his embodiment, it can also be provided that a part of the kinetic energy is reduced by the beads 11*b* of the holding sleeve 11 being torn out of the recesses 13 in the casing 3 of the spark plug connector plug device 2. In this variant, it is then provided that the shoulder 17 of the casing 3 is caught by the locking mechanism. Besides the variant shown in FIGS. 1 and 2 however it is alternately also possible that the locking mechanism and the casing 3, in the fault situation, do not change their relative position with respect to each other, but the energy is reduced purely by deformation of the spark plug connector plug device, preferably its casing 3 and the electrode 4.

In the second embodiment shown in FIGS. 3 and 4, instead of a screw means 8 a bayonet fastening is provided for fixing the spark plug connector plug device 2 to the engine block 1. In this alternative embodiment the part 7 of the locking mechanism, which is towards the spark plug connector plug device, has the nose 15 of the bayonet fastening, which in the locking position engages behind the part 6 of the locking mechanism, which is towards the engine block, so that the spark plug connector plug device 2 is locked to the engine block 1. For actuation purposes, the bayonet fastening which functions in per se known manner has the cover 9 which is operatively connected to the nose 15, and a spring 14. FIG. 4 shows the second embodiment of FIG. 3 in the fault situation.

In the embodiments discussed hereinbefore as shown in FIGS. 1 through 4 the kinetic energy of the expelled parts of the spark plug is reduced substantially by deformation of the casing material of the spark plug connector plug device 2 and optionally the center electrode 4. As an alternative thereto, as shown in the third embodiment illustrated in FIGS. 5 and 6, a spring element 16 may also be arranged between the locking mechanism and the casing 3 of the spark plug connector plug device. As shown, that can be in the form of a coil spring but it may also have other elastic material. In the fault situation shown in FIG. 6 the spring element 16 is upset, whereby the kinetic energy of the expelled spark plug parts is reduced. As also in the other embodiments, the increased pneumatic pressure can escape by way of the passage means 10. Various alternative configurations are conceivable in respect of the arrangement of the spring element 16. Thus it can also be provided that the casing 3 is of a two-part nature and the spring element is arranged therebetween.

In the case of large-size engines the casing 3 of the spark plug connector plug device 2, which is preferably made from polytetrafluoroethylene, is of a diameter of between 2 cm and 3 cm, preferably between 2.3 cm and 2.7 cm. The length of the spark plug connector plug device can be up to 30 cm and more in such engines.

The present invention is not limited to the illustrated embodiments. The man skilled in the art can make a suitable selection from what is already known, in respect of the materials and also the locking mechanisms used. The dimensioning of the spark plug connector plug device and the locking mechanism must then be so matched to the properties of the selected materials that the spark plug connector plug device is designed in accordance with the invention. Besides the locking mechanisms which are illustrated in the specific embodiments and which are to be actuated by hand, it is also possible to envisage other fixing devices which can be actuated by screw wrenches or the like, if that is deemed to be more appropriate.

The invention claimed is:

1. An internal combustion engine comprising at least one spark plug connector plug device which can be fixed to the internal combustion engine, wherein the spark plug connector plug device and the fixing thereof to the internal combustion engine withstand an application of force exerted on the spark plug connector plug device of at least 1000 Newtons.

2. The internal combustion engine as set forth in claim 1 wherein the spark plug connector plug device and the fixing thereof to the internal combustion engine withstand the application of force exerted on the spark plug connector plug device in the longitudinal direction of the spark plug connector plug device.

3. The internal combustion engine as set forth in claim 1 wherein the spark plug connector plug device and the fixing thereof to the internal combustion engine withstand an application of force exerted on the spark plug connector plug device at the level of the values recited in claim 1 at the temperatures of up to 80° C.

4. The internal combustion engine as set forth in claim 1 wherein the spark plug connector plug device has a sheathing casing and a locking mechanism, wherein the locking mechanism is of higher stiffness than the sheathing casing.

5. The internal combustion engine as set forth in claim 1 wherein the spark plug connector plug device has a sheathing casing wherein the sheathing casing has a modulus of elasticity of less than 2000 MPa.

6. The internal combustion engine as set forth in claim 1 wherein the spark plug connector plug device has a sheathing casing wherein the sheathing casing has a modulus of elasticity of less than 700 MPa.

7. The internal combustion engine as set forth in claim 1 wherein the spark plug connector plug device has a sheathing casing, wherein a spring element is arranged on the sheathing casing.

8. The internal combustion engine as set forth in claim 1 wherein the spark plug connector plug device has a sheathing casing wherein the sheathing casing has polytetrafluoroethylene.

9. The internal combustion engine as set forth in claim 1 wherein the at least one passage means for escaping gas is arranged in the spark plug connector plug device or in the internal combustion engine or between the spark plug connector plug device and the internal combustion engine.

10. The internal combustion engine as set forth in claim 9 wherein the passage means is of a labyrinth-like nature.

11. The internal combustion engine as set forth in claim 9 wherein the passage means is covered in such a way as to be resistant to spray water.

12. The internal combustion engine as set forth in claim 1 wherein it is a stationary gas engine.

13. An internal combustion engine as set forth in claim 1 wherein the spark plug connector plug device can be fixed to the internal combustion engine with a locking mechanism which can be fixed and released without the use of a tool and which involves a positively locking relationship.

14. The internal combustion engine as set forth in claim 13 wherein the spark plug connector plug device has a sheathing casing and wherein the locking mechanism is of higher stiffness than the sheathing casing.

15. The internal combustion engine as set forth in claim 13 wherein at least one passage means for escaping gas is arranged in the spark plug connector plug device or in the internal combustion engine or between the spark plug connector plug device and the internal combustion engine.

16. The internal combustion engine as set forth in claim 13 wherein the passage means is of a labyrinth-like nature.

17. The internal combustion engine as set forth in claim 13 wherein the passage means is covered in such a way as to be resistant to spray water.

18. A spark plug connector plug device which can be fixed to an internal combustion engine, wherein the spark plug connector plug device and a fixing thereof to the internal combustion engine withstand an application of force exerted on the spark plug connector plug device of at least 1000 Newtons.

19. A spark plug connector plug device as set forth in claim 18 wherein the spark plug connector plug device can be fixed to the internal combustion engine with a locking mechanism which can be fixed and released without the use of a tool and which involves a positively locking relationship.

* * * * *